US009459059B2

(12) United States Patent
Hamilton

(10) Patent No.: US 9,459,059 B2
(45) Date of Patent: Oct. 4, 2016

(54) MECHANISMS FOR FIRING PROJECTILES AND METHODS OF THEIR USE

(71) Applicant: Peter John Hamilton, Kaikoura (NZ)

(72) Inventor: Peter John Hamilton, Kaikoura (NZ)

( * ) Notice: Subject to any disclaimer, the term of this patent is extended or adjusted under 35 U.S.C. 154(b) by 0 days.

(21) Appl. No.: 14/399,744

(22) PCT Filed: Mar. 18, 2013

(86) PCT No.: PCT/NZ2013/000044

§ 371 (c)(1),
(2) Date: Nov. 7, 2014

(87) PCT Pub. No.: WO2013/169122

PCT Pub. Date: Nov. 14, 2013

(65) Prior Publication Data

US 2015/0135941 A1 May 21, 2015

(30) Foreign Application Priority Data

May 10, 2012 (NZ) ..... 599924

(51) Int. Cl.
*F41A 1/04* (2006.01)
*F41A 19/63* (2006.01)

(52) U.S. Cl.
CPC . *F41A 1/04* (2013.01); *F41A 19/63* (2013.01)

(58) Field of Classification Search
CPC ..... F41A 1/04; F41B 11/71; F41B 11/72
USPC ..... 89/7
See application file for complete search history.

(56) References Cited

U.S. PATENT DOCUMENTS

| | | | | |
|---|---|---|---|---|
| 3,969,978 | A | 7/1976 | Seifert et al. | |
| 4,193,335 | A | 3/1980 | Tassie | |
| 4,653,380 | A | 3/1987 | Griffing et al. | |
| 4,729,319 | A | 3/1988 | Orlando | |
| 7,926,403 | B1 * | 4/2011 | Vigil et al. | 89/7 |
| 7,947,137 | B2 | 5/2011 | Zubrin | |
| 2009/0133788 | A1 * | 5/2009 | Mungas et al. | 149/74 |

FOREIGN PATENT DOCUMENTS

| | | | |
|---|---|---|---|
| CH | 624480 | * | 7/1981 |
| DE | 4303881 A1 | | 8/1994 |

* cited by examiner

*Primary Examiner* — Stephen M Johnson
(74) *Attorney, Agent, or Firm* — Jacobson Holman, PLLC.

(57) ABSTRACT

A method of firing projectiles without the use of cartridge cases by electronically controlling the dynamics of internal ballistics created by combustion of Nitrous Oxide and a fuel injected under high pressure at oxygen rich or stoichiometric ratios. The shape of injector nozzles and the combustion chamber as well as a timed sequence of Nitrous Oxide injection, fuel injection and their ignition are used to create correct ballistics. The timing of the injection and ignition sequence is automatically altered dynamically by an electronic control unit that obtains information from sensors and from an operator to tune the combustion for each firing so that the internal ballistic pressure versus time curve is favorable.

13 Claims, 2 Drawing Sheets

MECHANISMS FOR FIRING PROJECTILES AND METHODS OF THEIR USE

TECHNICAL FIELD

This invention relates to mechanism's for firing projectiles, weapons, such as firearms technology primarily intended for all small arms categories as defined by military or by NATO terminology but could also be used for larger projectile weapons such as canons.

BACKGROUND

Historically firearm technology has evolved from the use of gunpowder. To achieve accuracy and reliability projectiles, gunpowder and a primer need to be encapsulated in a casing as ammunition. The casing needs to be accurately formed and be of soft metal, most commonly brass. These firearm weapons are of an entirely mechanical nature. If the casing system can be avoided there is a large saving in weight, volume and cost. This is known as "case-less ammunition". There has been much work done in this field using both solid and liquid propellants. In the case of liquid propellants there comes the opportunity to eliminate mechanical parts thereby increasing the flexibility and efficiency of the firearm's design.

An object of the invention is to provide firearms technology that meets those needs.

SUMMARY OF THE INVENTION

According to a broadest aspect the invention provides a method for firing projectiles by electronically controlling the injection and ignition of propellants in a combustion chamber which is part of an action which incorporates a breech mechanism which loads and holds projectiles ready for firing and a propellant injection system including a series of valves.

Preferably the propellants include nitrous oxide which is used as an oxidizer.

Preferably the propellant includes as a fuel a liquid or gas selected from the group consisting of alkane, alkene, cycloalkanes and alkyne based compounds, alcohols or mixtures thereof.

The invention in accordance with a second aspect includes a frame or gunstock housing for a barrel, an action, a projectile magazine, a propellant storage system which can be detachable, an electronic control unit (ECU) and a battery, the action incorporating a combustion chamber, a breech mechanism that feeds a projectile from the magazine, a fuel injector, an oxide injector, valves, a spark ignition device and means for channeling the propellants to the combustion chamber.

Further aspects of the invention will become apparent from the following description which is given by way of example only.

DESCRIPTION OF THE DRAWING

Schematic drawings are attached which show the workings of an example weapon in accordance with the invention in which.

DESCRIPTIONS OF THE EXAMPLES

Figure 1:
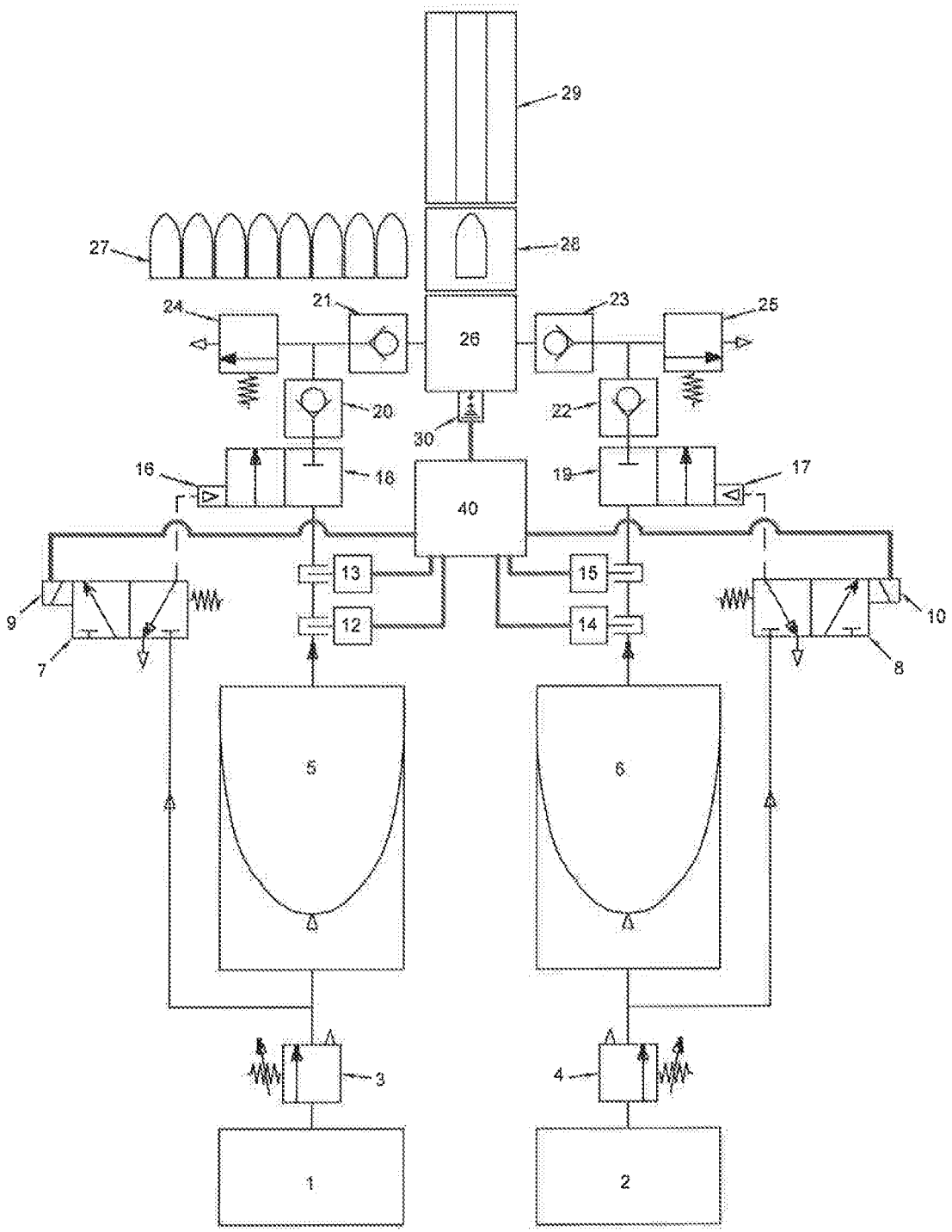
FIG. 1 is a schematic of an example of mechanism for firing projectiles according to the first aspect of the invention.

In FIG. 1 is shown a nitrous oxide injection system and a fuel injection system both of which have similar components. A nitrous oxide container 5 and a fuel container 6 each have a bladder or diaphragm allowing their pressurization by inert gas from containers 1 and 2. Regulators 3 and 4 respectively are used to regulate the pressure to not less than 100 bar in the containers 5 and 6. The bladder or diaphragm allows pressurization of the nitrous oxide and the fuel without it mixing with the inert gas. The inert gas pressurizes the fuel and the nitrous oxide via the regulator 3 and 4, which keep each propellant at 100 bar or more. In each of the injection systems, nitrous oxide and fuel is allowed to flow to respective poppet valves 18 and 19, which acts as injectors. These valves are normally in the closed position being actuated by trigger pull via pilot valves 16 and 17 respectively, which allow the poppet valve injectors 18 and 19 to lift and allow fluid to flow to a combustion chamber 26. Fluid (fuel and oxidizer), after being released by their injectors 18 and 19 pass through two check valves 20 and 21, and 22 and 23 respectively before entering the combustion chamber 26. Between the check valves 20 and 21, and 22 and 23, there are blow-off valves or pressure release valves 24 and 25. The two check valves and blow-off valve on each line protect the injection system from inadvertent back flow of gases or liquid from the combustion chamber 26, which would endanger the system. The pilot valves 16 and 17 which actuate the poppet valve injector on each line are each driven by a spool valve 7 and 8 respectively which allow inert gas to lift the pilot valves 16 and 17 to actuate each poppet valve injector 18 and 19. A solenoid 9 and 10 on each spool valve 7 and 8 is actuated (at trigger pull) by electrical current from an ECU. A spark device 30 is then actuated to initiate timed ignition at around the end of the injection cycle such that injection is not disturbed by the resulting very rapid pressure rise.

Figure 2:
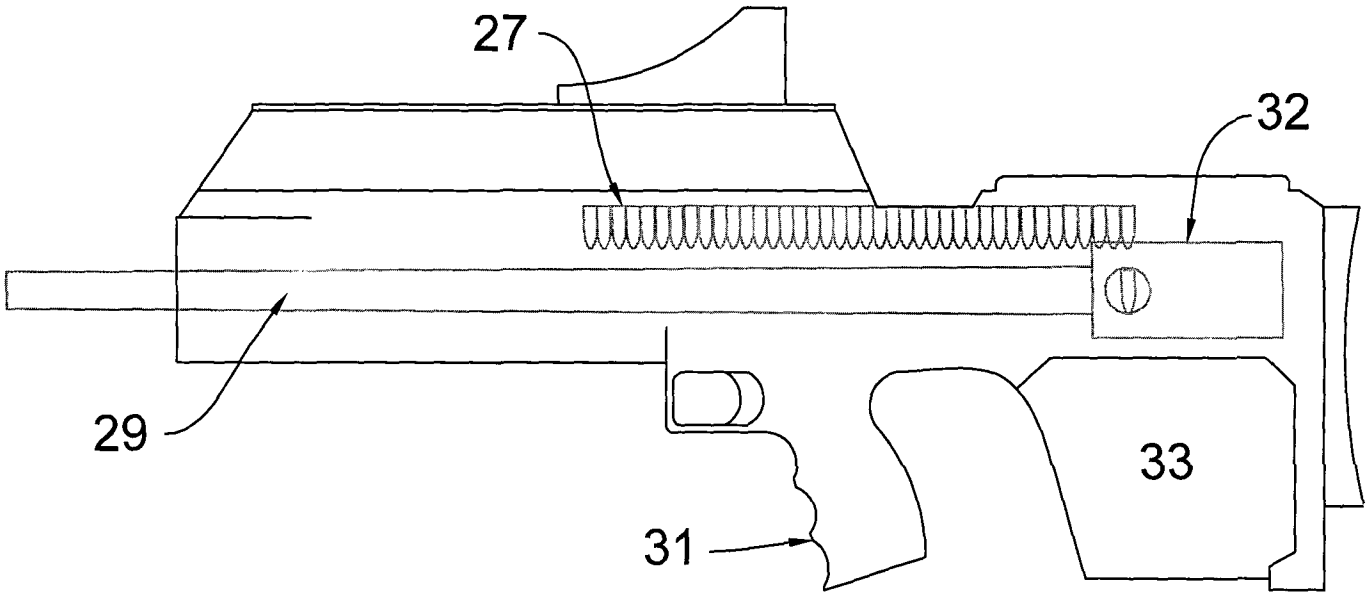
FIG. 2 is a side view of an example of the invention according to a second aspect of the invention.

In FIG. 2 is shown an example where the barrel 29, action 32, projectile magazine 27, and detachable propellant canister 33, are mounted on a gunstock or frame 31. It is in scale to indicate size. The example holds 80 rounds in its magazine and the propellant storage volume is for 200 rounds based on the 5.56 NATO caliber or a muzzle energy of 1800 joules. The barrel is 18 inches long (460 mm) and the entire weapon is 22 inches (560 mm) long. The battery and ECU are not shown in FIG. 2. The scale of FIG. 2 indicates how the use of this invention can reduce the size and mechanical complexity of a weapon.

The invention uses fuel and nitrous oxide as propellant. The inert gas is used to pressurize the propellant to above its critical pressure. The critical pressure or vapor pressure is that pressure below which a liquid becomes a gas. Holding the propellants at or above that pressure ensures that it does not turn into a gas within the system. If it boils and turns into gas anywhere in the system it becomes less dense and therefore less powerful as a propellant. Inert gas is stored on the weapon at a pressure of between 200 and 400 bar. It can be nitrogen, helium, argon or any other suitable inert gas.

The fuel can be any hydrocarbon. The fuel can also be a mixture of hydrocarbons and can include inhibitors, which slow down the burn rate of the fuel. The fuel mix is selected to achieve the desired burn rate in relation to the design of the weapon i.e. caliber size, length of barrel, projectile speed needed and the multiple power settings a particular model may have. Generally hydrocarbons with longer carbon chains will be slower burning than those with short carbon chains. The fuel and oxidizer are injected at stoichiometric ratios. If nitrous oxide is used as an oxidizer, mixtures from five parts oxidizer to one part fuel to about ten parts oxidizer to one part fuel can be used depending on the fuel type, i.e. if methane were used which has four carbon molecules in it's chain then the stoichiometric ratio of at least six point one parts nitrous oxide to one of fuel by volume may be used whereas if octane which has 8 carbon molecules were used the ratio would be nine to one.

The invention uses an Electronic Control Unit or ECU 40 to control the fuel injector valve 19, the nitrous oxide injector valve 18 and the ignition timing. The ECU is tuned for the specific application or model it is used in and for the specific fuel blend designed for that model. Temperature and pressure sensors shown in FIGS. 1 as 12, 13, 14 and 15 can give additional information to the ECU. User selectable settings can also be fed to the ECU. A user can select a power setting which tells the ECU to inject a lesser or greater amount of fuel and oxidizer with a corresponding increase or decrease of projectile speed. The ECU can also be used to display information to the user such as propellant levels, projectile numbers used or still held in the magazine, the selectable mode in use etc. It can also shut the weapon down if a programmed safety parameter has been breached. In this way many different flexible and inflexible modes and sensors can be used in conjunction with the ECU. One example is where a. keypad is used to lock and unlock the weapon to deny access to unauthorized persons. Also a remote radio or other signal could be used by the ECU to disable the weapon.

There are several factors which greatly influence the combustion of the propellants in this invention. A propellant for a projectile weapon must not burn too fast or too slow to be effective. If it burns too fast it may over pressurize the breech and barrel causing projectile deformation or even catastrophic failure. If it burns too slowly it will not propel the projectile efficiently, wasting its power after the projectile has left the barrel. One factor in controlling this has been briefly discussed above i.e. the mixing of different types of hydrocarbons and the inclusion of inhibitors. For the understanding of this invention the applicant now discusses some of the other factors which influence combustion in the combustion chamber. Some of these other factors are: A, the temperature and pressure of the propellant and the timing of fuel injection in relation to the nitrous oxide. B, the physical shape and size of the combustion chamber. C, the shape and placement of the inlet valves in the combustion chamber (shown as 21 and 23 in FIG. 1 of the drawings). And D, the timing of ignition.

In the invention the governing principle of combustion that is too fast or in other words detonation, is the homogeneous mixing of fuel and oxidizer i.e. if the mixture is too homogeneous detonation may occur sending pressures too high. A good balance must be achieved by surrounding the fuel with oxidizer so that when ignition takes place there is an even flame front created. The points A, B, C and D above are used to achieve that. The dynamics inside the combustion chamber are very complex but the principle remains the same, to generate a flame front rather than detonation. The combustion chamber can be filled with both oxidizer and fuel within 15 milliseconds or less depending on the design. Different dynamics can be set up by programming the ECU with specific injection and ignition timing. Each increment in timing can change the pressure versus time curve of the internal ballistics. Once good physics are achieved inside the combustion chamber varying the ignition timing by very small increments has an effect on internal ballistics. So the secret lies in the tuning of the ECU for correct injection and ignition in relation to a particular combustion chamber design, fuel blend and the ballistics required for the application. A well designed combustion chamber and inlet valve combination can give a wide range of ballistic profiles and because propellant injection and ignition timing can be controlled down to the microsecond, it is possible to achieve very repeatable ballistics.

For safety the two components of the propellant namely the nitrous oxide and the fuel must remain separate at ALL times without exception before entering the combustion chamber. The fuel injection system and the nitrous oxide injection system is therefore built in such a way that they remain completely separated even in the event of component failure. The two systems must be separated by an escape to the outside atmosphere to be redundant and that includes the inert gas pressurization system.

The breech mechanism shown as 28 in FIG. 1 of the drawings, can have various mechanical design arrangements with the principle that it must load a projectile from the projectile magazine 27 and seal with the combustion chamber 26 and barrel 29 enough that acceptable amounts of propellant will not escape before firing. In one design the propellant injection and ignition happens within a very small time period allowing tolerances for sealing to be comparatively large. In another design ignition timing occurs at a much greater time delay and so the breech mechanism must seal like a valve. In one design the projectile acts like a piston being pushed forward by the propellant as it is injected until it is seated in the bore of the barrel ready for firing. There are many varieties of applications for the invention within the firearms category including handguns, submachine guns, assault rifles, grenade launchers, light and heavy machine guns and sporting firearms each with their own design parameters for the breech mechanism. In FIG. 2 an assault rifle is illustrated using a rotary breech configuration which loads projectiles from a magazine 27 held along the top of the weapon thus saving space. This is one of the advantages of the invention, because only projectiles are loaded by the breech as there are no casings as with conventional firearms, the breech can be much shorter and therefore have much less inertia. In one design a pressurized gas stored on the weapon can be used to move the breech to reload a projectile, thus eliminating the need for gas porting the barrel and the associated mechanical actuators, further decreasing the weight and mechanical complexity of the weapon as well as increasing it's ease of manufacture.

Where in the foregoing description particular mechanical parts or integers are referred to it is envisaged that their mechanical equivalents can be substituted therefore and fall within the scope of the invention.

Thus by the invention there is provided a mechanism for firing a projectile and a method of its use.

Particular examples of the invention have been described by way of example and it is envisaged that improvements and modifications can take place without departing from the scope of the attached claims.

The invention claimed is:

1. A method of firing projectiles comprising the steps of:
providing propellants comprising nitrous oxide and a fuel;
injecting the propellants into a combustion chamber through inlet valves; and
igniting the propellants,
wherein, combustion rate and combustion power are controlled by timed sequence of (a) nitrous oxide injection, (b) fuel injection and (c) their ignition, the timed sequence being adapted to be automatically adjusted by a programmed electronic control unit that obtains information from sensors and from a user to control combustion and hence controlling pressure versus time curve associated with internal ballistics for each firing.

2. The method as claimed in claim 1 wherein the nitrous oxide is used as an oxidizer.

3. The method as claimed in claim 2 wherein the fuel is a liquid or gas selected from the group consisting of alkane, alkene, cycloalkanes and alkyne based compounds, alcohols or mixtures thereof.

4. The method as claimed in claim 3 wherein a nitrous oxide container and a fuel container are used and each has a bladder or diaphragm allowing their pressurization by inert gas from inert gas containers.

5. The method as claimed in claim 4 wherein regulators are used to regulate the pressure in the fuel and nitrous oxide containers to not less than 70 bar.

6. The method as claimed in claim 5 Wherein the nitrous oxide and the fuel is allowed to flow to respective valves, which act as injectors, the valves are normally in their closed position and are actuated by trigger pull via pilot valves.

7. The method as claimed in claim 6 wherein the fuel and the nitrous oxide after being released by their injectors pass through separate check valves before entering the combustion chamber and wherein between the check valves there are blow-off valves or pressure release valves.

8. The method as claimed in claim 7 wherein the pilot valves which actuate the injector valves are actuated by a solenoid which is actuated by electrical current from the electronic control unit which is initiated at trigger pull.

9. The method as claimed in claim 8 wherein the electronic control unit controls the fuel injector valve, the nitrous oxide injector valve and the ignition timing.

10. The method as claimed in claim 8 wherein a user can select a power setting which tells the electronic control unit to inject a lesser or greater amount of the fuel and the nitrous oxidizer with a corresponding increase or decrease of projectile speed.

11. The method as claimed in claim 10 wherein temperature and pressure sensors give additional information to the electronic control unit.

12. The apparatus incorporating a method of firing projectiles as claimed in claim 1.

13. The apparatus as claimed in claim 12 which includes a barrel, a breech mechanism, a propellant storage system which can be detachable, the electronic control unit, a battery, the combustion chamber, a fuel injector, an oxide injector, valves and a spark ignition device.

* * * * *